United States Patent [19]

Warner

[11] Patent Number: 4,514,918

[45] Date of Patent: May 7, 1985

[54] PANTS PRESSER WITH SPRING GRIPPING DEVICE

[76] Inventor: David Warner, 999 Green St., #1905, San Francisco, Calif. 94133

[21] Appl. No.: 528,577

[22] Filed: Sep. 1, 1983

[51] Int. Cl.[3] ..... D06F 71/28

[52] U.S. Cl. ..... 38/36; 38/71; 269/254 CS

[58] Field of Search ..... 24/549, 566, 129 D, 24/465, 644; 400/233; 83/460, 387, 389; 38/1 C, 1 D, 27, 36, 71; 100/220; 269/254 CS; 223/73

[56] References Cited

U.S. PATENT DOCUMENTS

| | | | |
|---|---|---|---|
| 2,931,546 | 4/1960 | Brunier | 223/73 |
| 3,070,910 | 1/1963 | De Dube | 38/71 |
| 3,145,490 | 8/1964 | Corby | 38/71 |
| 3,491,469 | 1/1970 | Niehenke | 38/71 |
| 3,513,573 | 5/1970 | Corby | 38/71 |
| 3,584,351 | 6/1971 | Sliwinski | 269/254 CS |
| 4,228,707 | 10/1980 | Arlett | 83/387 |

*Primary Examiner*—Henry S. Jaudon
*Assistant Examiner*—Andrew M. Falik
*Attorney, Agent, or Firm*—Blakely, Sokolodd, Taylor & Zafman

[57] ABSTRACT

A pants presser having two flat members with facing surfaces, a heatable sheet covering at least one of the members, and a flexible pad proximate with the heatable sheets. A gripping bar is proximate with the bottom of one of the flat members for gripping the bottom of a pair of pants by pressing the pants against the other flat member, the gripping bar being movably mounted to retract substantially linearly and transversely to the plane of the member with which it is proximately mounted. A latching bar is pivotally mounted proximate with one of the members such that it latches to the other member, the latching bar having at least three detents, a full open detent for freely installing a pair of pants thereon, a half-closed detent in which the bottoms of the pants are securely held while the remainder of the pants are free and a closed detent in which the pants are tightly pressed between the flat members.

10 Claims, 7 Drawing Figures

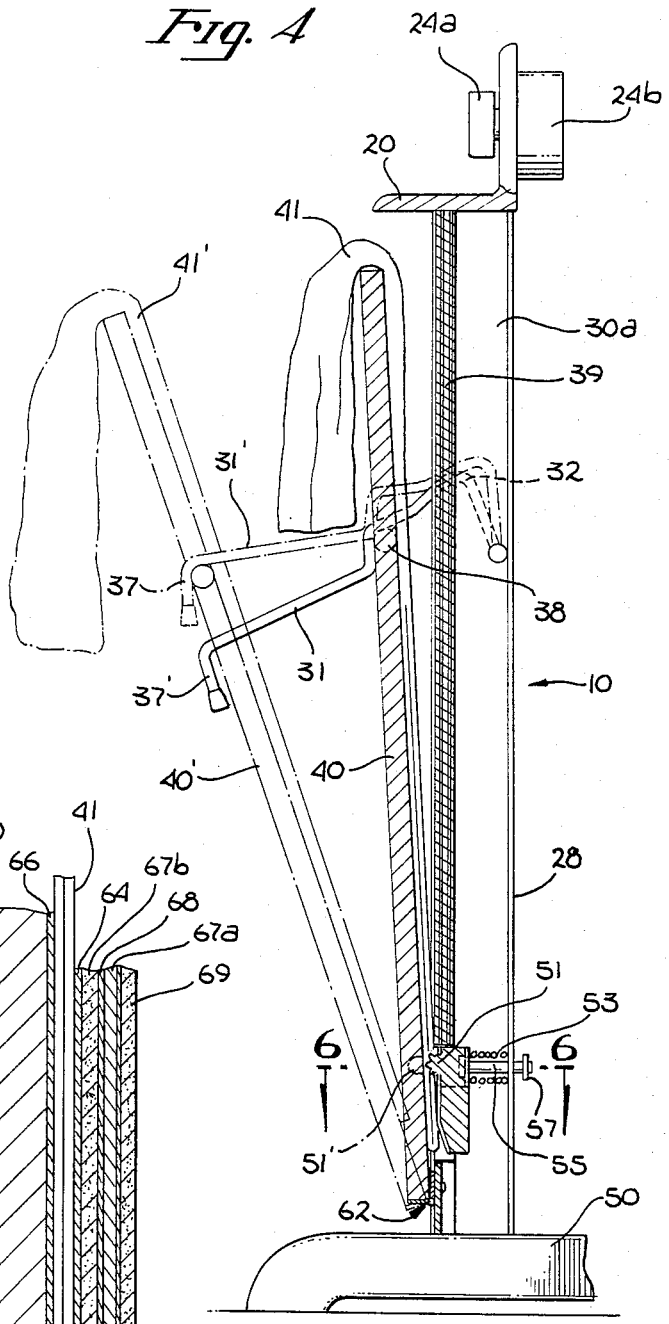
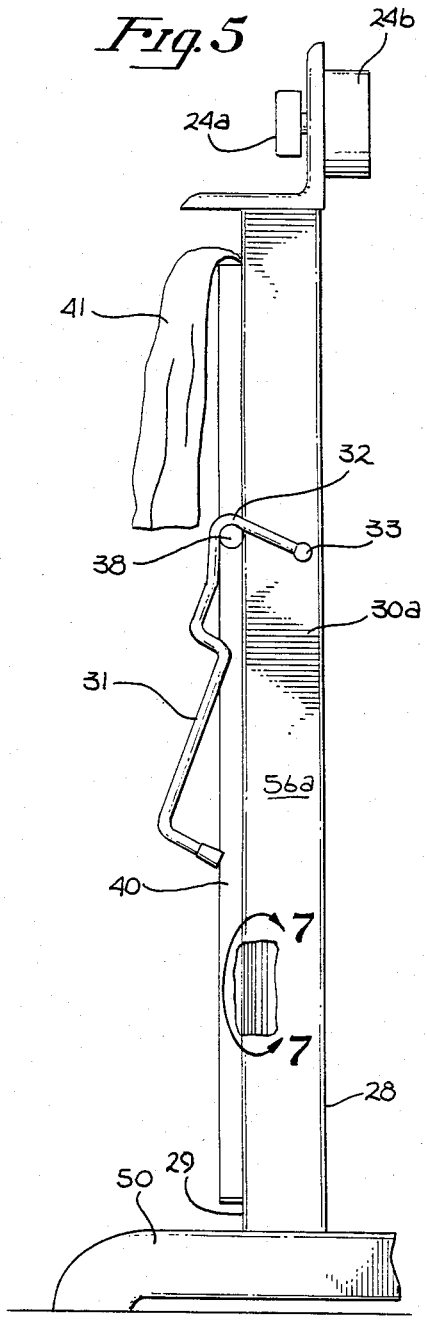
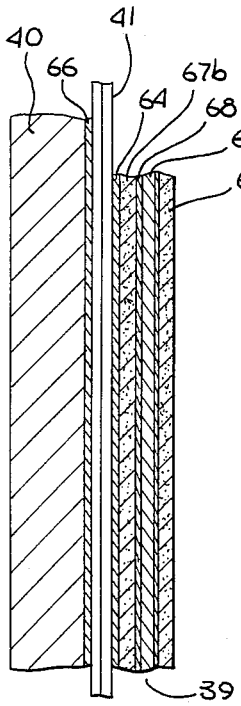
Fig. 7
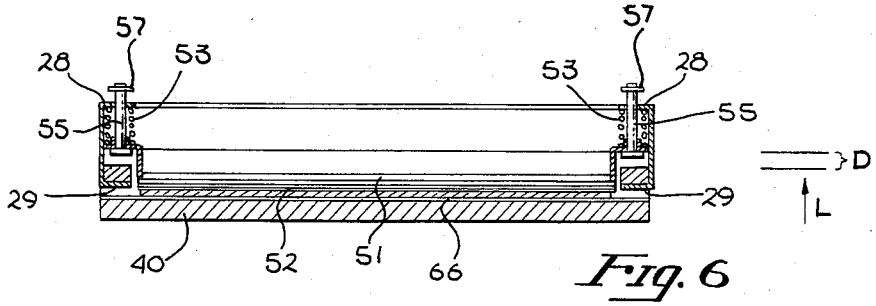
Fig. 6

PANTS PRESSER WITH SPRING GRIPPING DEVICE

BACKGROUND OF THE INVENTION

This invention relates to a pants presser which allows the user to longitudinally stretch and press a pair of pants while simultaneously applying heat thereto.

Pants pressers are known in the art which grip and stretch a pair of pants before they are pressed. Such prior art pants pressers as exemplified in the patent to P. J. S. Corby, U.S. Pat. No. Re. 27,368, and are generally provided with two flat members between which the pants are pressed, a handle for opening and closing together the two flat members, a gripping means which grabs and stretches the pants and a means for heating the pants. The Corby device requires that the pants have cuffs of reasonable thickness so that the cuff gripper of said device is able to securely grasp the cuffs of the pants. The cuff gripper is designed to recess from the plane of the flat member with which it is associated. The Corby device is also provided with stretcher bars which grab the top and the bottom of the pants and stretch said pants longitudinally in opposite directions. However, the Corby device is deficient in that said stretcher bars are not adjustable, as such, and provide the same amount of longitudinal stretch movement without regard to the type of pants material and the ability of such material to stretch. Moreover, the user of this device has no control over the amount and angle of the stretch, so that if the user incorrectly installs installs the pants in the pants presser, he is unable to detect the existence of wrinkles caused by improper installation of the pants since the pants presser closes as the pants are stretched thereby precluding observation of the pants during the stretching action.

Another prior art device is described in the patent of De Dube, U.S. Pat. No. 3,070,910. This device comprises two flat members and two gripping bars each suspended on a leaf springs at the top and bottom of one of said members. The leaf springs urge the gripping means toward the moving flat member on which the pants are installed. Thus, as the flat members are closed together, the gripping means press the pants against the moving member on which said pants are installed, and stretches the pants a predetermined amount as a result of the movement of the gripping means away from its origin. The drawbacks of the De Dube device include the potential for creases in the pants to occur where the pants cannot be viewed after they are in a stretched position since the members are closed together at that point. Further, the predetermined amount of stretch is a function of the configuration of the leaf spring which cannot take into account the variable stretchability of different types of material, and with the possible result of overstretching and fabric stress. Also, this device is more complex and consequently more expensive than necessary to achieve the desired result, in that the leaf spring must be properly arched to apply the desired tension and stretch a pair of pants. Moreover, the leaf spring requires more space than is necessary for other spring types due to the arcuate movement of the gripping means on the leaf spring. As a result, the gripping means cannot to be positioned close to the bottom of the flat member on which it is installed.

SUMMARY OF THE INVENTION

The present invention comprises two flat members having facing surfaces between which pants are pressed, one member being stationary and the other being angularly movable with respect to the stationary flat member, a heatable sheet covering at least one of said flat members, a gripping means which securely grasps the bottom of the pants while allowing the remainder of the pants to be stretched by the operator and which, when deflected from its rest position moves in a horizontal direction generally transverse to the plane of the flat member with which it is associated, and a latching means with at least three detent positions such that in a first position, the pants may be installed on said movable member without contacting the gripping means, in a second position the bottom of the legs of the pants are gripped while the remainder of the pants are free and can be stretched upward by an operator, and in a third position the pants are pressed between said flat members. The shape of the gripping means is such that it can be disposed near the bottom of the pants presser so as to provide the greatest amount of usable surface area of the flat members for pressing.

BRIEF DESCRIPTION OF THE DRAWINGS

FIG. 4 is a side view of the pants presser showing the moving member in the half-closed position in solid lines, and in the full open position in phantom lines.

FIG. 5 is a side view of the pants presser in the full closed position.

FIG. 6 is a top view of the pants presser taken through lines 6—6 of FIG. 4.

FIG. 7 is an enlarged side view of the intersection of the members of the pants presser as depicted in the portion circumscribed by line 7—7 of FIG. 5.

DESCRIPTION OF THE SPECIFIC EMBODIMENT

Figure 1:
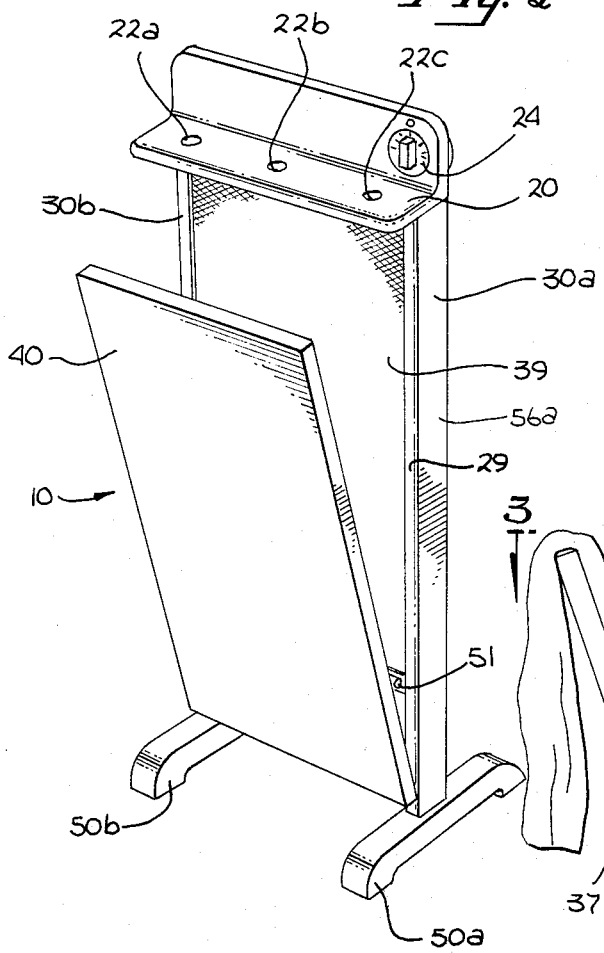
FIG. 1 is a perspective view of the pants presser without the latch bar.
Figure 2:
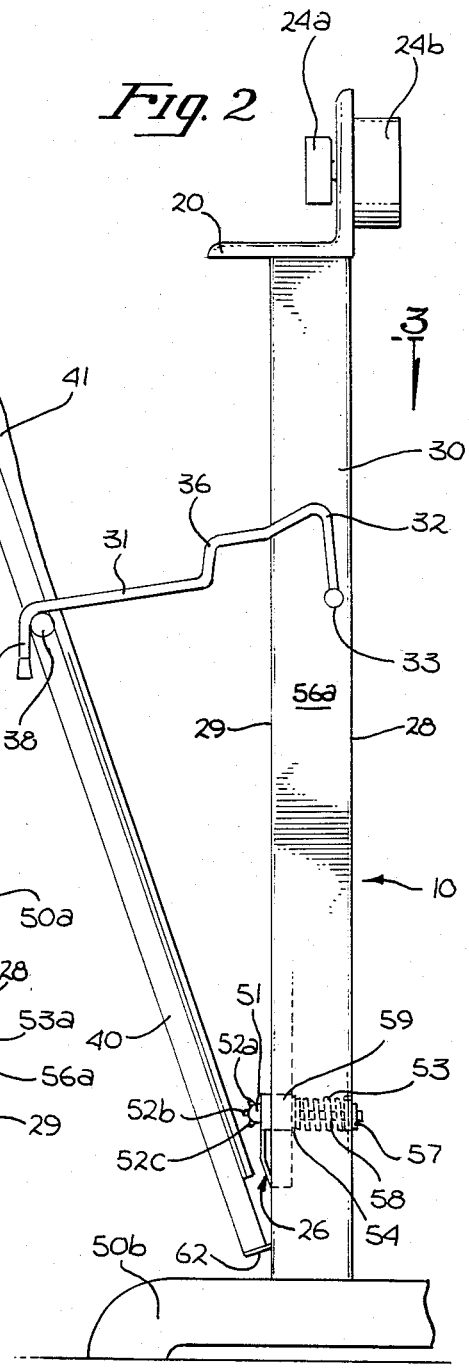
FIG. 2 is a side view of the pants presser in the full open position with a pair of pants installed thereon.

Referring now to FIGS. 1 and 2, the preferred embodiment of the pants presser 10 of the present invention comprises a stationary member 39 and a movable member 40, which is angularly pivotable with respect to member 39. Members 39 and 40 are preferably made of wood although any temperature resistant material capable of forming a rigid sheet, such as metal or plastic may be used. Member 39 is attached to a base 50 and has an upper portion 20 which in the preferred embodiment contains indentations 22*a–c* for storing articles found in the pockets of trousers. Also provided therein is a variable switch 24 for selectively controlling the time setting of the pants presser, comprising a knob 24*a* and housing 24*b* containing circuitry for controlling the time setting.

A gripping means 51, which is set between side brackets 30*a* and 30*b*, is disposed near the bottom of stationary member 39. The body of gripping means 51 is angled at its bottom portion 26 to correspond approximately to the angle between movable member 40 and to stationary member 39 when the movable member is first brought into the half-closed position at which point it contacts the gripping means (see FIG. 4).

Referring now specifically to FIG. 2, a pair of pants 41 is installed on the movable member 40 of the pants presser 10. The latch bar 31 is hooked at detent 37 onto knob 38 maintaining the pants presser in the full open position. As shown, the latching bar also comprises a half-opened detent 36 and a closed detent 32. The number of detents shown is not limiting but is for illustrative purposes only and it will be obvious to one skilled in the art that more detents can be provided without departing from the scope of this invention. The latch bar 31 is connected to the side bracket 30*a* at pivot 33. The movable member 40 is connected to the stationary member 39 by means of a hinge at 62 (not shown). In the full open position gripping means 51 does not contact the movable member 40 or the installed trousers 41.

Figure 3:
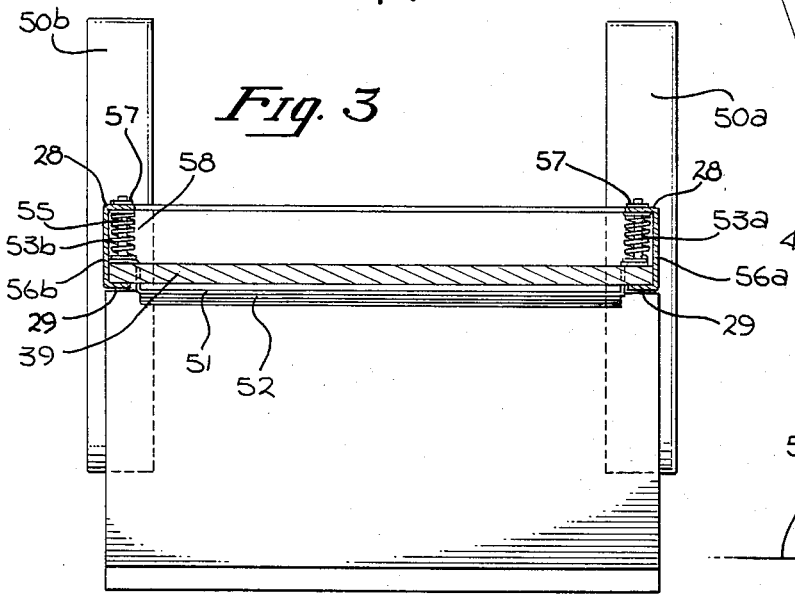
FIG. 3 is a top view of the invented pants presser taken through line 3—3 of FIG. 2.

With reference to FIGS. 2 and 3, gripping means 51 is installed between the front 29 and back 28 portions of the side brackets 30*a* and 30*b* and is supported by shafts 55 which extend from the front to the back portion of the side brackets and, aft of the gripping means, each is surrounded by a coil spring 53. This mounting system stabilizes the movement of the gripping means which should not wobble when it is deflected backward toward the back portions 28. Springs 53 urge the gripping means forward and against the front portions 29 of the side panels 30*a* and 30*b*, the gripping means' forward motion being restrained thereby.

The gripping means is preferably formed of a one piece molded construction. On its forward surfaces, ribs 52*a–c* are provided on the gripping means in the preferred embodiment for increased gripping capability. In other embodiments, the gripping means can be smooth, roughened, or formed or coated with a material with relatively high friction characteristics with respect to pants materials, such as an adhesive type material.

FIG. 4 shows the pants presser in the half-closed position in the solid lines and the open position in the phantom lines. In the open position, the member 40' is held in position by the latch bar 31' resting against the knob 38 at detent 37. In this position, the gripping means 51' extends toward but does not touch the member 40' or pants 41' thereby allowing the pants to be fully installed down to the bottom of the pants presser 10.

In the half-closed position, the knob 38 rests in the middle detent 36. The gripping means 51 is forced against the pants 41 by the coil springs 53, tightly securing the bottom of the pants 41 against member 40. Due to the angular shape of the lower portion 26 of gripping means 51, the movable member 40 does not cause the pants bottoms to contact the gripping means 51 until movable member 40 approaches the middle detent position. Also as a result of the angled shape of the bottom portion 26 of the gripping means, the gripping means 51 may be disposed close to the hinge at 62 without significant obstruction of the motion of the movable member 40.

The pants 41 are freely movable except in the region where the gripping means contacts the pants bottoms. Therefore, in order to stretch the pants, and thereby smoothing out wrinkles and preventing the formation of unwanted creases during the pressing operation, an operator pulls the pants into position by pulling upward on the pants from the top. The pants are stretched in accordance with the stretchability of the material at the time the operator stretches the pants. As a result of the visibility of the pants afforded in the half-closed position, the condition of the pants can be observed to determine whether there are creases therein.

In the preferred embodiment, the latching bar is angled so that the operator can close the members together with one hand while holding the stretched pants taut with the other hand to insure that no wrinkles occur during closing operation. When an operator forces the latching bar 31 in the downward direction, the downward pressure on knob 38 urges member 40 toward member 39 until the members are tightly pressed together and locked in place. The knob 38 is recessed and locked in position in detent 32 as shown in FIG. 5. Said detent 32 is preferably of a configuration such that the bar 31 cannot slip out of position. In another embodiment, the latching bar can be held in place by any locking means such as a loop or clasp which locks the movable member in the closed position.

FIG. 6 shows gripping bar 51 urged a distance D from its resting position by the movable member 40 in direction L which is substantially transverse to the plane of the stationary member 39, in a substantially linear and horizontal motion as the coil spring 53 is compressed.

Now referring to FIG. 7, the movable member 40 is preferably made of chip-board or other wood material. Member 39 is comprised of a board 69, preferably chipboard, covered by a heating sheet comprising an electric heating element 68 surrounded by a two temperature resistant, foam pads 67*a* and 67*b* facing members 39 and 40. The surface of foam pad 67*a* which faces the pants is covered by a smooth cloth material 64. The flexible foam pad permits the pressing of pants 41 of varying thicknesses due to seams, pockets, cuffs, and the like. The surface of movable member 40 may also be covered with a foam and cloth material 66. A temperature sensor (not shown) is attached to heating element 68, and electrically connected to the circuitry in housing 24*b*.

Thus, the pants presser of the present invention has been described. It will be appreciated by one skilled in the art that a number of changes, substitutions and alterations can be made to the preferred embodiment without departing from the scope of the invention. The scope of the invention is indicated by the appended claims rather than by the foregoing description, and all changes which come within the meaning and range of equivalency of the appended claims are therefore intended to be embraced therein.

What is claimed is:

1. A pants presser comprising:

first and second flat members having facing surfaces between which pants are pressed, said second member being maintained in a a substantially vertical plane by a pair of support brackets, one of which is disposed along each vertical side edge of said second member, and said first member being angularly movable with respect to said second member;

a heatable sheet covering at least one of said members;

a pants gripping means attached near the bottom of said second flat member, said gripping means being mounted so that it moves substantially linearly and transversely to the plane of said second flat member when said first member is closed against said second flat member; and, a latching means connecting said first flat member to said second flat member for urging said first flat member towards said second flat member and maintaining said first flat member at predetermined angles with respect to said second flat member, said latching means comprising a knob disposed upon the side edge of said first flat member, and a latch bar pivotally connected to one of said support brackets on the same side of said presser as said knob, said latch bar comprising at least three detents, wherein the first detent is disposed furthest from the pivoted connection to said support brackets at a position whereby when said knob is seated in said first detent, said gripping means is not in contact with said first flat member so that the pants can be installed in said pants presser without obstruction;

the second detent is disposed at an intermediate distance from said pivoted connection, whereby when said knob is seated in said second detent, said first and second flat members are angularly disposed with respect to each other such that said gripping means is urged against and proximate with said first flat member, thereby gripping the bottom of pants installed thereon such that said pants bottoms are securely held in place while the remainder of the pants are free; and, the third detent is disposed closest to said pivoted connection, whereby when said knob is seated in said third detent, said flat members are held in vertical adjacent relation with each other such that said pants installed thereon are pressed therebetween.

2. The pants presser of claim 1 wherein said detents comprise elbow bends whereby the application of downward force to said latch bar urges said first member towards said second member, so that said latch bar can be operated with one hand.

3. The pants presser of claim 1 wherein said gripping means comprises:

a retractable friction bar movably mounted on a shaft, extending through the front and back portions of said support bracket said friction bar having a one piece construction with an upper portion in a plane substantially parallel to the plane of said second member and a lower portion angled such that when said first member abuts said gripping means, said lower portion is approximately parallel to said first member whereby said lower portion of said gripping means does not interfere with the radial motion of said second member, and coil spring surrounding said shaft and disposed between said friction bar and said back portion of said bracket for urging said friction bar toward said first flat member,

4. The pants presser of claim 3 wherein said friction bar further comprises ridges on the surface facing said first member whereby the gripping of the bottoms of said pants is improved.

5. The pants presser of claim 1 further comprising a flexible resilient pad proximate to said heatable sheet.

6. A pants presser comprising:

first and second flat members having facing surfaces, said first flat member being angularly movable with respect to said second flat member;

two vertical support brackets, one connected to each vertical edge of said second flat member, each of said brackets having a front and back portion;

a heatable sheet disposed upon one of said flat members;

a flexible resilient pad disposed over said heatable sheet;

a retractable pants gripping bar disposed below the bottom of said second flat member and movably mounted upon shafts extending through said front and back portions of said support brackets, said gripping bar being urged towards said first flat member by a coil spring surrounding each of said shafts and disposed between said gripping bar and said back portion of said support brackets;

a latching bar pivotally connected to one of said vertical support brackets, said latching bar having three detents along the length of said bar; namely a full open detent, a half-closed detent, and a full closed detent;

a knob disposed on the side of said first flat member whereby said knob can be disposed within said detents of said latching bar;

said detents being disposed along said latching bar such that when said knob is disposed within said full open detent, said flat members are disposed a distance apart such that pants may be freely inserted between said first flat member on the one hand, and said second member and said gripping bar on the other hand; when said knob is disposed in said half-closed detent, the bottoms of said pants are secured between said gripping bar and said first flat member and the remainder of said pants is freely movable; and, when said knob is disposed in said closed detent, said pants are pressed between said flat members.

7. The pants presser of claim 6, wherein said gripping bar comprises a single molded piece structure having a ribbed upper portion for securily gripping the bottoms of pants and an angled lower portion, said lower portion having a front surface which is substantially parallel to said first flat member when said first flat member is disposed in the half-closed position and is abutting said gripping bar.

8. The pants presser of claim 7, wherein said ribbed portion of said gripping bar is comprised of rubber.

9. The pants presser of claim 7, wherein said ribbed portion of said gripping bar is comprised of plastic.

10. An improved pants presser of the type comprising first and second flat members having facing surfaces, said first flat member being angularly movable with respect to said second flat member, a flexible resilient pad disposed over at least one of said flat members, and a latching means for holding said flat members at predetermined angular positions with respect to each other, the improvement comprising:

two vertical support brackets, each bracket having front and back portions, one bracket disposed on each side of said second flat member;

a gripping means comprising a gripping bar disposed below the bottom of said second flat member for holding the bottoms of pants installed in said pants presser against said first flat member, said gripping bar being of a molded one piece construction and having ribs thereon facing said first flat member, said gripping bar being mounted on two shafts, one shaft extending through each of said front and back portions of said vertical support brackets;

a coiled spring disposed around each of said shafts between said back portion of said support bracket and said gripping bar for urging said gripping bar towards said first flat member, whereby said gripping bar retracts when said flat members are pressed together;

said latching means comprising a latching bar, said latching bar being pivotably connected to the outside edge of one of said vertical support brackets at a pivot point, and a knob disposed on the corresponding edge of said first flat member nearest said pivot point, said latching bar having three detents disposed along its length such that:

when said knob is disposed in the first detent, which is disposed furthest away from said pivot point, said pants may be installed between said first and second flat members without being obstructed by said gripping bar, when said knob is disposed in the second detent, which is disposed closer to said pivot point, said gripping bar securely holds the bottoms of pants installed in said pants presser against said first flat member while the remainder of said pants is freely movable, and when said knob is disposed in the third detent, which is disposed closest to said pivot point, said flat members are held pressed together.

* * * * *